US005653446A

United States Patent [19]

Lin

[11] Patent Number: 5,653,446

[45] Date of Patent: Aug. 5, 1997

[54] TOY GRIPPING MACHINE

[76] Inventor: Men Wei Lin, 2nd Fl., 20, Ta Hsing Street, Taipei, Taiwan

[21] Appl. No.: 514,026

[22] Filed: Aug. 11, 1995

[51] Int. Cl.[6] ..... A63F 9/00

[52] U.S. Cl. ..... 273/447; 221/210

[58] Field of Search ..... 446/426, 424, 446/425; 273/448, 447; 221/210

[56] References Cited

U.S. PATENT DOCUMENTS

| | | | |
|---|---|---|---|
| 4,157,183 | 6/1979 | Meyer et al. | 446/330 X |
| 5,271,628 | 12/1993 | Okada | 273/448 |
| 5,397,134 | 3/1995 | Fishman et al. | 273/448 |

*Primary Examiner*—Mickey Yu
*Attorney, Agent, or Firm*—Bacon & Thomas

[57] ABSTRACT

A toy gripping machine including a machine base covered with a transparent covering to hold candies, a suspension arm assembly movably mounted on the machine base inside the transparent covering and having a grab controlled to grip the candies, a control arm assembly controlled to adjust the elevation of the suspension arm assembly, a driving arm assembly controlled to turn the suspension arm assembly horizontally and to open/close the grab in gripping the candies, and a stop bar assembly controlled to open the passage between a sloping slide way and an outlet for permitting the caught candies to be delivered out of the machine base.

4 Claims, 7 Drawing Sheets

TOY GRIPPING MACHINE

BACKGROUND OF THE INVENTION

The present invention relates to a toy gripping machine played to grip candies by means of controlling the position of a suspension arm assembly and operating a grab.

Various toy gripping machines have been disclosed for gripping a variety of toys. These toy gripping machines commonly have a fixed suspension arm and a grab suspended from the suspension arm and controlled to grip toys.

SUMMARY OF THE INVENTION

It is one object of the present invention to provide a toy gripping machine which can be technically operated to adjust the elevation and angular position of the suspension arm in gripping candies. It is another object of the present invention to provide a toy gripping machine which has a transparent covering to hold candies on the inside for showing. It is still another object of the present invention to provide a toy gripping machine which is inexpensive to manufacture. According to the preferred embodiment, the toy gripping machine comprises a machine base covered with a transparent covering to hold candies, a suspension arm assembly movably mounted on the machine base inside the transparent covering and having a grab controlled to grip the candies, a control arm assembly controlled to adjust the elevation of the suspension arm assembly, a driving arm assembly controlled to turn the suspension arm assembly horizontally and to open/close the grab in gripping the candies, and a stop bar assembly controlled to open the passage between a sloping slide way and an outlet for permitting the caught candies to be delivered out of the machine base.

DETAILED DESCRIPTION OF THE PREFERRED EMBODIMENT

Figure 1:
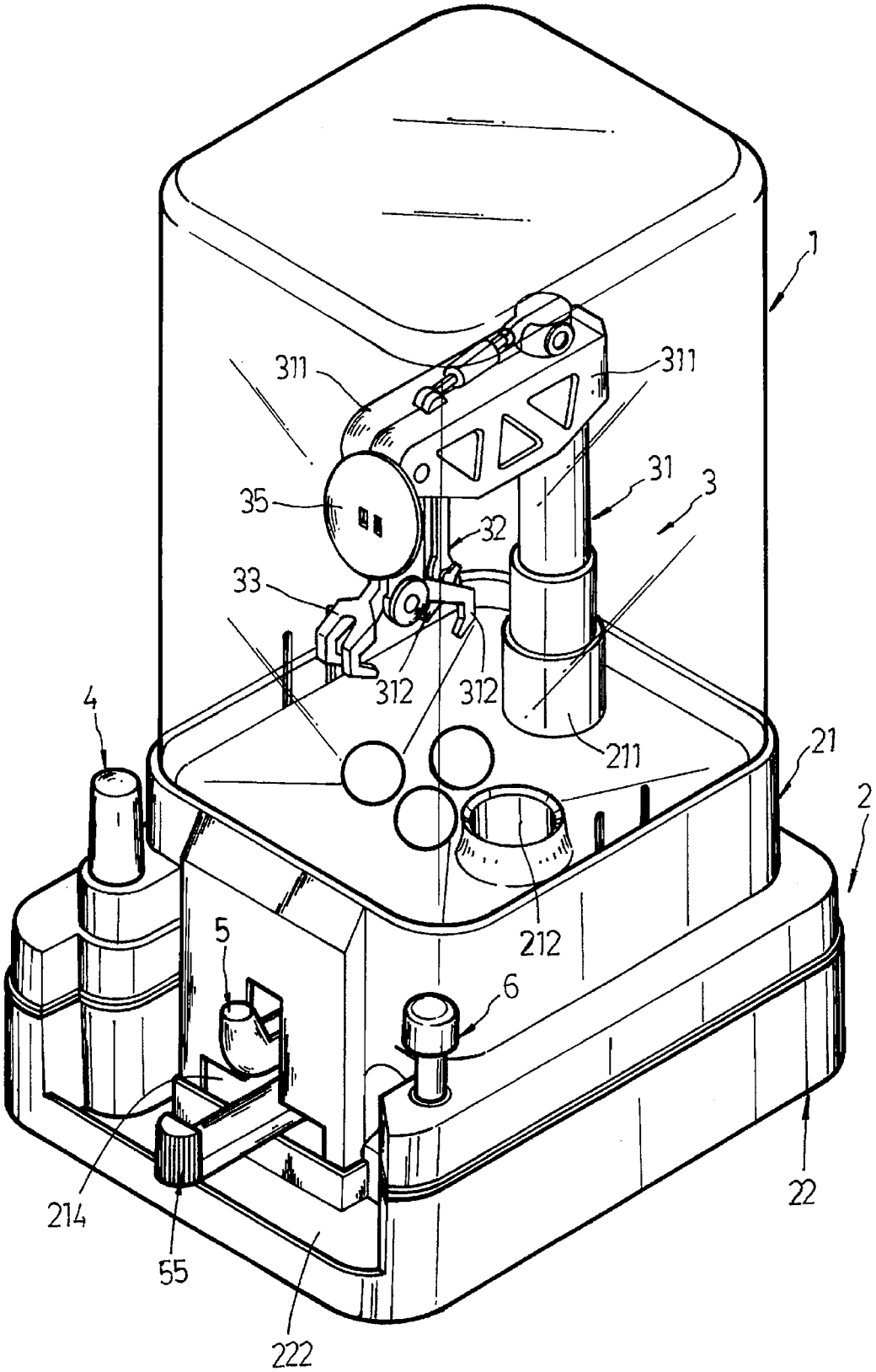
FIG. 1 is a perspective view of a toy gripping machine according to the present invention.
Figure 2:
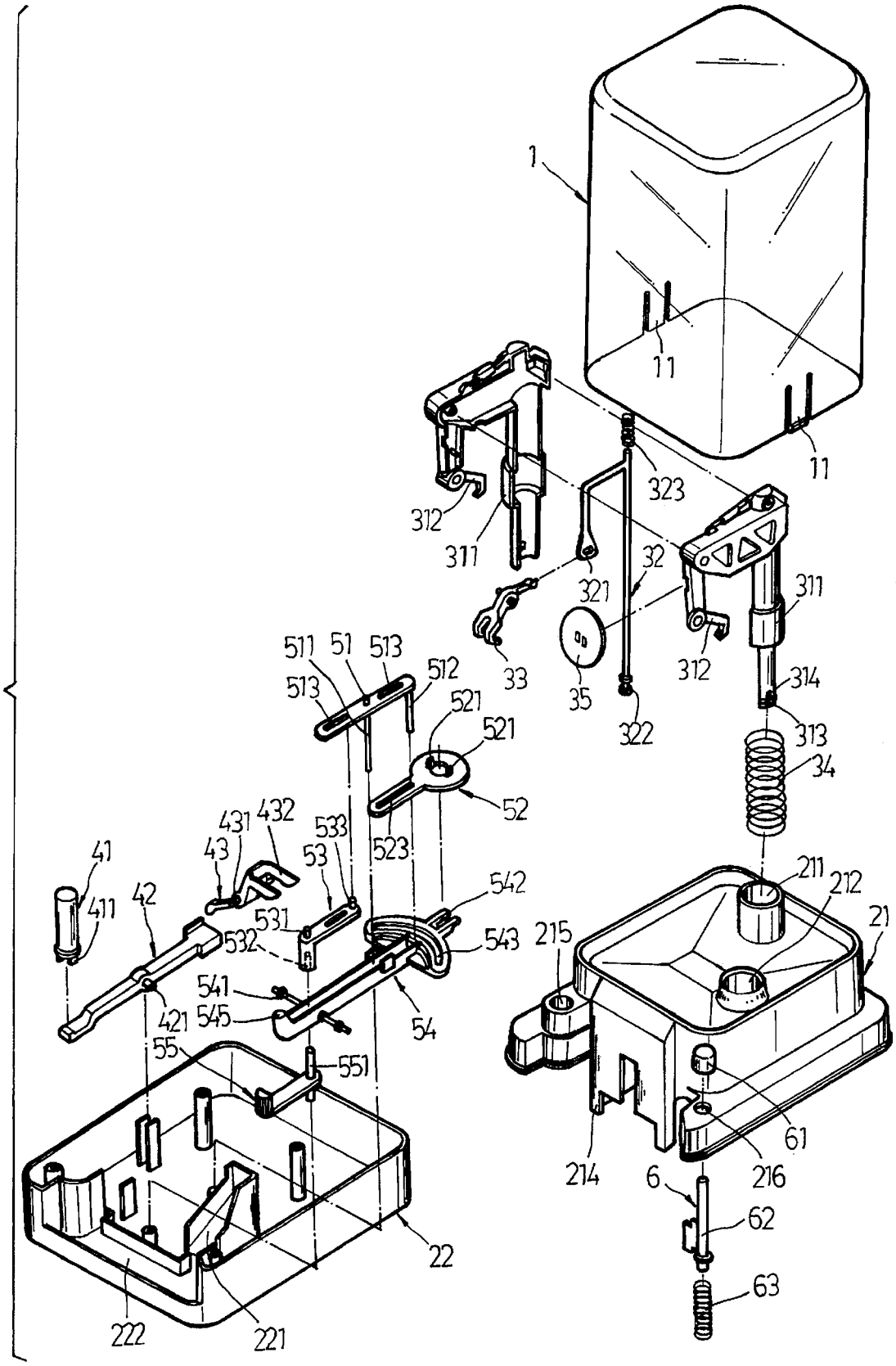
FIG. 2 is an exploded view of the toy gripping machine shown in FIG. 1.
Figure 3:
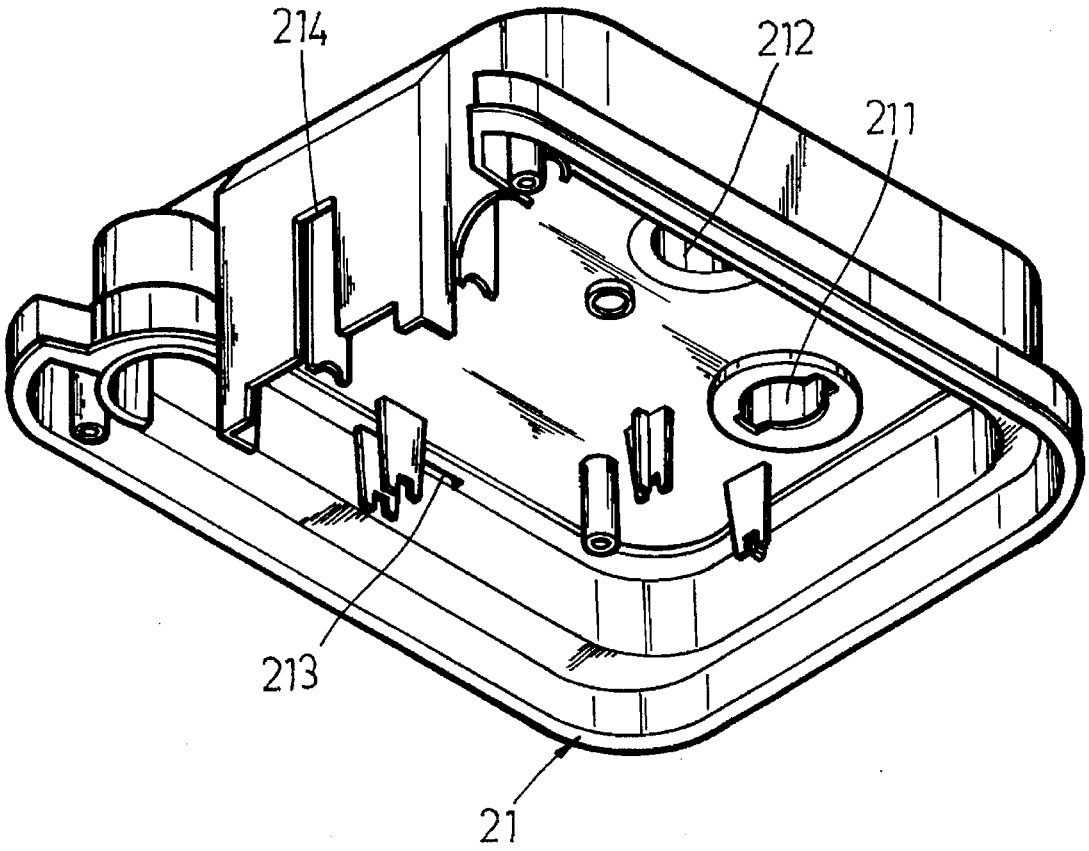
FIG. 3 is a bottom view of the upper casing of the machine base of the toy gripping machine shown in FIG. 1.
Figure 4:
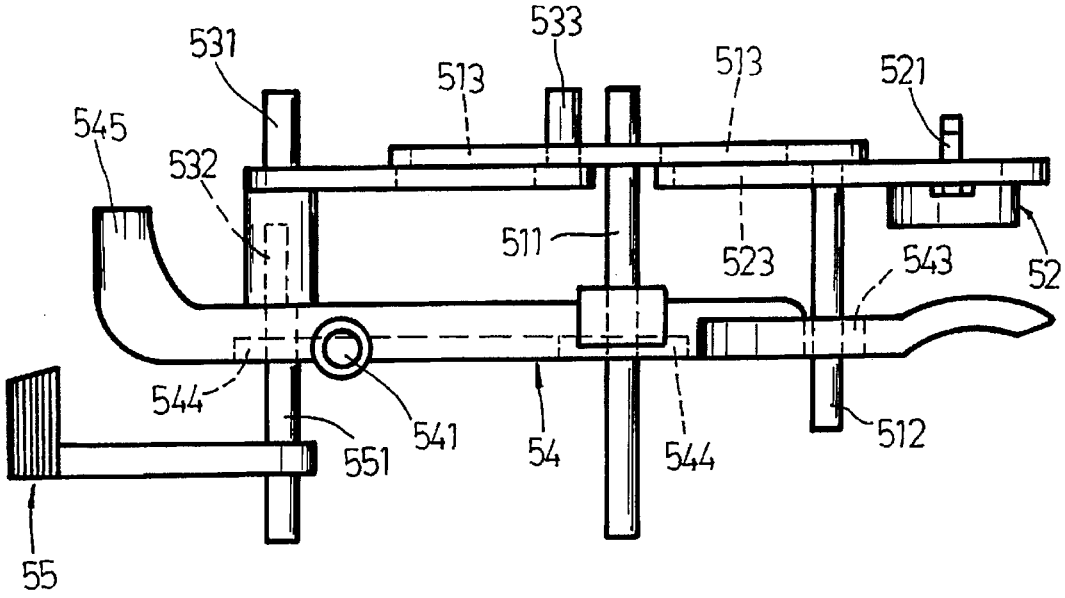
FIG. 4 is a side view of the driving arm assembly of the toy gripping machine shown in FIG. 1.

Referring to FIGS. 1, 2, 3, and 4, a toy gripping machine in accordance with the present invention is generally comprised of a transparent covering 1, a machine base 2, a suspension arm assembly 3, a control arm assembly 4, a driving arm assembly 5, and a stop bar assembly 6. The transparent covering 1 encloses the top of the base 2 to hold candies on the inside, having two downward hooks 11 bilaterally disposed at the bottom and respectively hooked on the machine base 2. The machine base 2 is comprised of a bottom casing 22 and an upper casing 21 supported on the bottom casing 22. The upper casing 21 comprises a vertical axle housing 211, a vertical through hole 212, two retaining holes 213 for engagement with the downward hooks 11 of the transparent covering 1, a front opening 214, a control arm mounting hole 215, and a stop bar mounting hole 216. The bottom casing 22 comprises a sloping slide way 221 and an outlet 222 in communication with the sloping slide way 221. The suspension arm assembly 3 is mounted on the vertical axle housing 211 of the upper casing 21, and is comprised of a hollow suspension arm 31, a link 32, a movable pawl 33, a compression spring 34, and an ornamental disk 35. The suspension arm 31 is comprised of two symmetrical frames 311, each frame 311 having a fixed pawl 312 at the top end, a raised portion 313 and a recessed portion 314 at the bottom end. The ornamental disk 35 is mounted on the suspension arm 31 at the front side. The link 32 is shaped like the number "7" and inserted into the hollow suspension arm 31, and includes a coupling hole 321 at the front end coupled with the movable pawl 33, which acts with the fixed pawls 312 of the frames 311 of the hollow suspension arm 31, a bottom coupling portion 322 around the periphery of the bottom end, and a return spring 323 at the top end. The control arm assembly 4 comprises a control arm 41, a link 42, and an actuating arm 43. The control arm 41 is inserted through the control arm mounting hole 215, having a coupling portion 411 at the bottom end coupled to one end of the link 42. The link 42 is coupled between the control arm 41 and the actuating arm 4, having a transverse pivot 421 in the middle pivotably mounted in the bottom casing 22. The actuating arm 43 has one end coupled to the link 42, a transverse pivot 431 in the middle pivotably mounted in the upper casing 21, and a front end terminating in a substantially U-shaped coupling portion 432 for coupling to the suspension arm assembly 3. The driving arm assembly 5 comprises a link 51, a coupling head 52, a connecting arm 53, a holder arm 54, and a driving arm 55. The holder arm 54 and the driving arm 55 are respectively extended out of the front opening 214 of the upper casing 21 for operation by hand. The link 51 comprises a coupling rod 511 in the middle revolvably connected between the upper casing 21 and the bottom casing 22, a front guide rod 512, and two elongated guide slots 513 longitudinally disposed at two opposite ends. The coupling head 52 is mounted around the suspension arm 31, having two opposite raised portions 521 and two opposite recessed portions 522 bilaterally disposed at one end and respectively engaged with the recessed portions 314 and raised portions 313 of the frames 311 of the suspension arm 31, and an elongated guide slot 523 at an opposite end movably coupled to the front guide rod 512 of the link 51. The coupling arm 53 comprises an upright guide rod 533 at the front end for movement in the elongated guide slot 523 of the coupling head 52, an upright pivot 531 at the rear end pivotally engaged in a hole (not shown) inside the upper casing 21, and a half-round hole 532 at the bottom end of the pivot 531. The holder arm 54 comprises a front coupling portion 542 at the front end, an upright handle 545 at the rear end, an arched transverse sliding groove 543 near the front coupling portion 542 for the sliding of the front guide rod 512 of the link 51, a transverse pivot 541 disposed near the upright handle 545 and pivotably mounted inside the upper casing 21, and two longitudinal slots 544 for coupling the coupling rod 511 of the link 51 and a front coupling rod 551 of the driving arm 55. The front coupling rod 551 of the driving arm 55 has a half-round top end inserted through one longitudinal slot 544 of the holder arm 54 and fitted into the half-round hole 532 of the coupling arm 53, and a circular bottom end revolvably coupled to the bottom casing 22. The stop bar assembly 6 comprises a stop bar 62 inserted through the stop bar mounting hole 216 of the upper casing 21, an end cap 61 fastened to the top end of the stop bar 62 outside the upper casing 21, and a spring coil 63 mounted around the bottom end of the stop bar 62 and stopped against the bottom casing 22.

Figure 5:
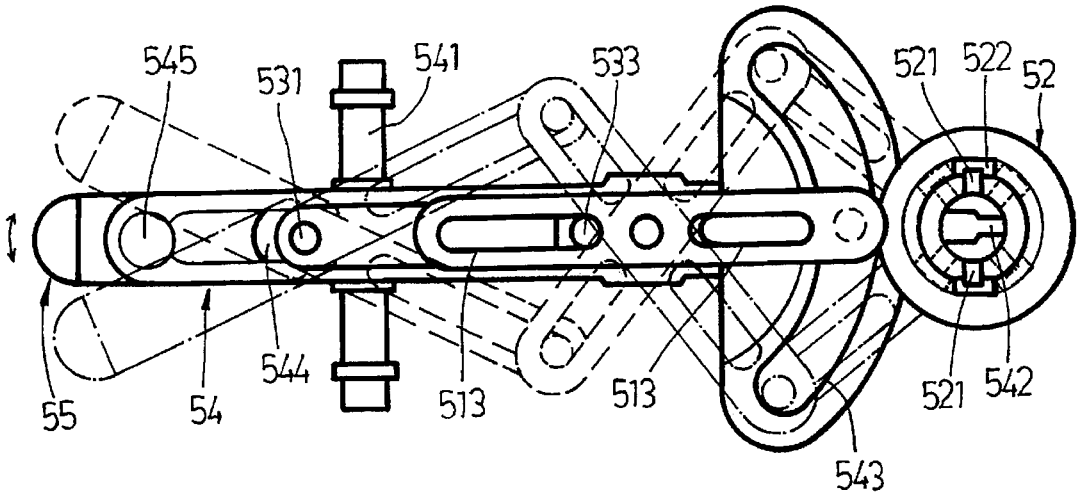
FIG. 5 is a top view of the driving arm assembly of FIG. 4 in operation.

Referring to FIG. 5, the driving arm assembly 5 is coupled to the suspension arm assembly 3, and controlled to turn the suspension arm assembly 3 horizontally in the vertical axle housing 211 of the upper casing 21. When the driving arm 55 is moved leftward, the coupling arm 53 is turned rightward, causing the link 51 to be turned leftward. When the link 51 is turned leftward, the coupling head 52 is turned leftward, and therefore the suspension arm assembly 3 is turned in one direction. On the contrary, when the driving arm 44 is moved rightward, the suspension arm assembly 3 is turned in the reversed direction.

Figure 6:
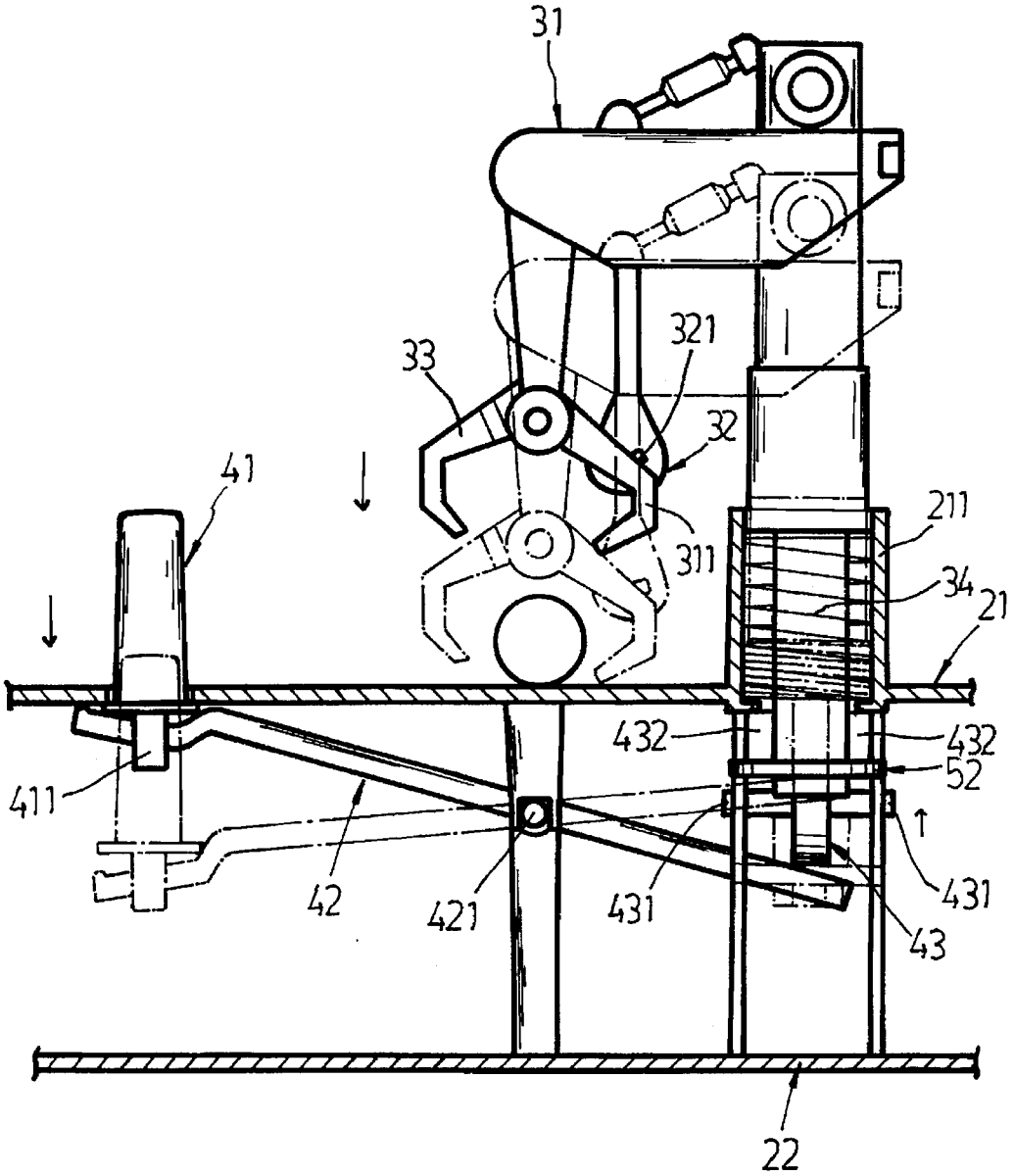
FIG. 6 is a side view showing the control arm assembly of the toy gripping machine of the present invention in operation.

Referring to FIG. 6, when the control arm 41 is depressed, the link 42 forced to turn the actuating arm 43, causing the coupling portion 432 of the actuating arm 43 moved downwards. When the coupling portion 432 of the actuating arm 43 is moved downwards, the suspension arm 31 is relatively lowered to compress the compression spring 34. When the control arm 41 is released, the compression spring 34 323 automatically pushes the suspension arm 31 back to its former position.

Figure 7:
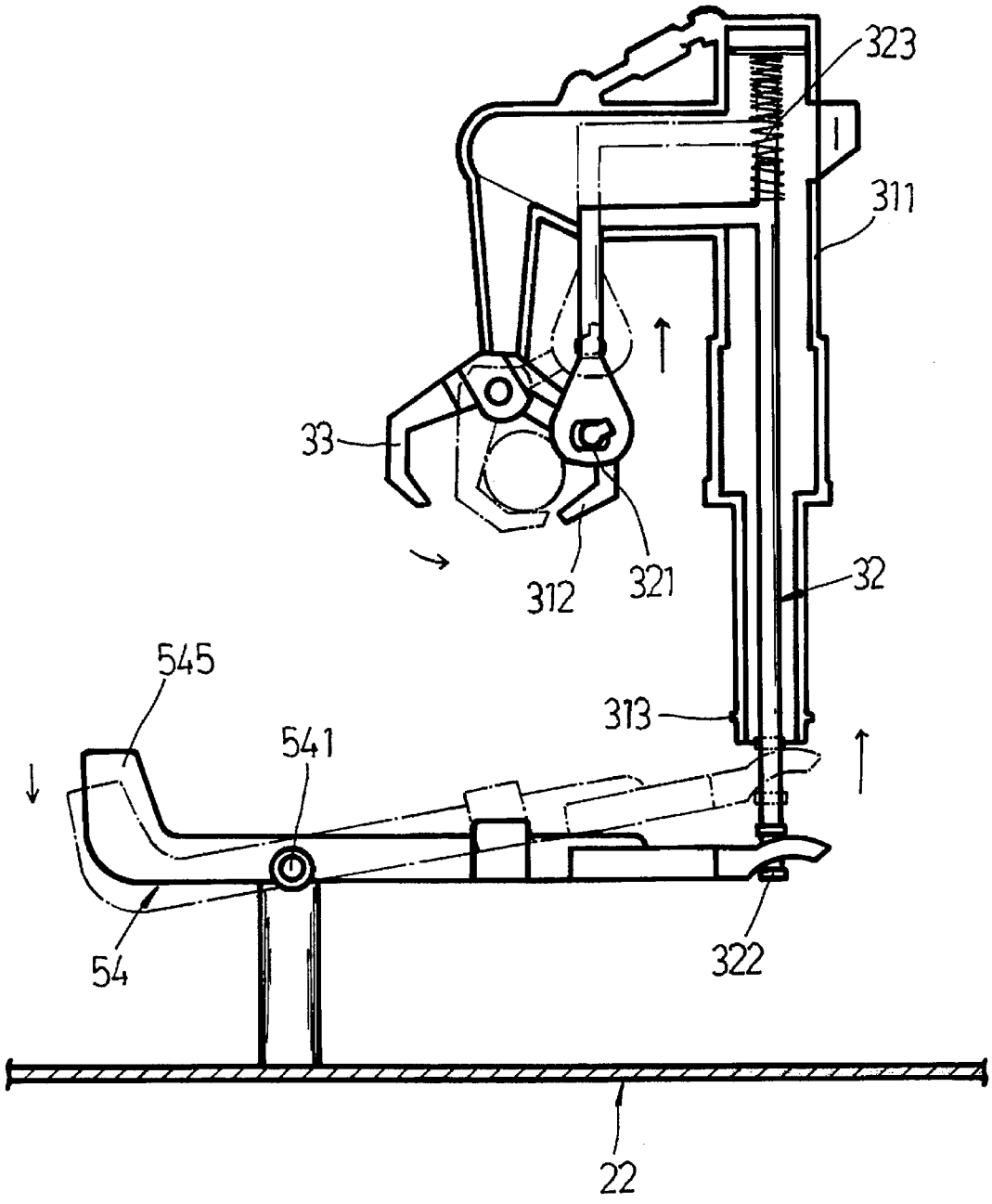
FIG. 7 shows the suspension arm assembly driven by the driving arm assembly according to the present invention.

Referring to FIG. 7, the front coupling portion 542 of the holder arm 54 is Coupled to the bottom coupling portion 322 of the link 32. When the upright handle 545 is depressed, the link 32 is lifted to turn the movable pawl 33 toward the fixed pawls 312 for gripping candies.

Figure 8:
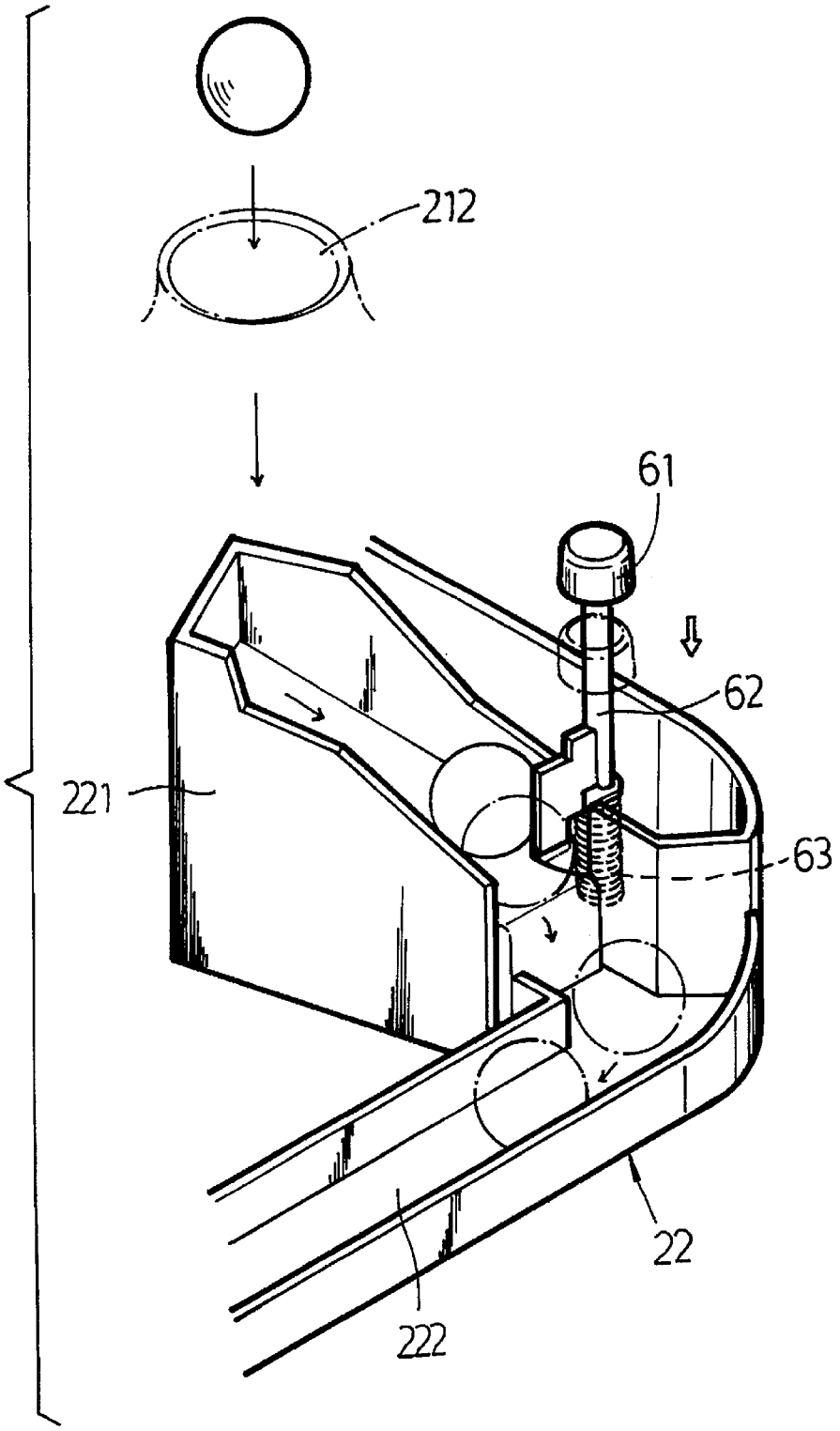
FIG. 8 shows the stop bar assembly operated according to the present invention.

Referring to FIG. 8, when candies are caught by the pawls 33 and 312 of the suspension arm assembly 3 and put in the the vertical through hole 212, the caught candies move through the sloping slide way 221 and stopped in place by the stop bar 62 of the stop bar assembly 6. When the stop bar 62 is depressed, the passage between the sloping slide way 221 and the outlet 222 is opened for permitting the caught candies to move from the sloping slide way 221 to the outlet 222.

It is to be understood that the drawings are designed for purposes of illustration only, and are not intended as a definition of the limits and scope of the invention disclosed.

I claim:

1. A toy gripping machine comprising:

a machine base, said machine base comprising a bottom casing and an upper casing covered on said bottom casing, the upper casing comprising a vertical axle housing, a vertical through hole, two opposite retaining holes, a front opening, a control arm mounting hole and a stop bar mounting hole spaced around a border of the upper casing, said bottom casing comprising a sloping slide way in communication with said vertical through hole, and an outlet in communication with said sloping slide way;

a transparent covering enclosing a top portion of the upper casing, said transparent covering having two opposite downward hooks respectively hooked in the retaining holes of said upper casing;

a suspension arm assembly movably mounted in the vertical axle housing of said upper casing inside said transparent covering, said suspension arm assembly having grab means controlled to grip an object from said upper casing and to put the gripped object in the vertical through hold of said upper casing;

a control arm assembly mounted in the control arm mounting hole of said upper casing and controlled to move said suspension arm assembly vertically in said vertical axle housing;

a driving arm assembly mounted in said machine base and extending out of the front opening of said upper casing for turning said suspension arm assembly horizontally in said vertical axle housing and opening or closing said grab means of said suspension arm assembly; and a stop bar assembly mounted in the stop bar mounting hole of said upper casing and being depressible to open the passage between said sloping slide way and said outlet, said stop bar assembly comprising a stop bar having a top end extended out of said stop bar mounting hole and a bottom end suspended in said bottom casing, an end cap mounted on the top end of said stop bar, and a spring coil mounted around the bottom end of said stop bar and engaged against said bottom casing.

2. The toy gripping machine of claim 1 wherein said suspension arm assembly comprises a hollow suspension arm, a link, a grab means, a compression spring, and an ornamental disk, said suspension arm comprised of two symmetrical frames, each frame having a top end coupled to said grab means and a bottom end formed with a raised portion and a recessed portion for engagement with said driving arm assembly, said ornamental disk being mounted on said suspension arm at a front side thereof, the link of said suspension arm assembly being movable in said suspension arm and having a front end, a bottom end coupled to said driving arm assembly, and a top end coupled with a return spring, the return spring being disposed in engagement against the top ends of the symmetrical frames of said grab means comprising two fixed pawls respectively and fixedly fastened to the frames of said suspension arm, and a movable pawl pivotably connected between the frames of said suspension arm and coupled to the link of said suspension arm assembly and moved by the link of said suspension arm assembly to act with said fixed pawls.

3. The top gripping machine of claim 1 wherein said control arm assembly comprises a control arm inserted through the control arm mounting hole of said upper casing, an actuating arm pivotably mounted in said bottom casing and having a front end coupled to said suspension arm and a rear end coupled to one end of said control arm by a link.

4. The toy gripping machine of claim 1 wherein said driving arm assembly comprises a link, a coupling head, a connecting arm, a holder arm, and a driving arm, said holder arm and said driving arm being respectively extended out of the front opening of said upper casing for manual operation, the link of said driving arm assembly comprising a coupling rod in the middle revolvably connected between said upper casing and said bottom casing, a front guide rod, and two elongated guide slots longitudinally disposed at two opposite ends, said coupling head being mounted around said suspension arm and having two opposite raised portions and two opposite recessed portions bilaterally disposed at one end and respectively engaged with the recessed portions and raised portions of the frames of said suspension arm, and an elongated guide slot at an opposite end movably coupled to the from guide rod of the link of said driving arm assembly, said coupling arm comprising an upright guide rod at one end movable in the elongated guide slot of said coupling head, an upright pivot at an opposite end pivotally engaged in a hole inside said upper casing, and a half-round hole at a bottom end of the pivot of said coupling arm, said holder arm comprising a front coupling portion at one end, an upright handle at an opposite end extended out of the front opening of said upper casing, an arched transverse sliding groove near said front coupling portion for the sliding of said front guide rod, a transverse pivot disposed near said upright handle and pivotably mounted inside said upper casing, and two longitudinal slots coupled to the coupling rod of the link of said driving arm assembly and the front coupling rod of said driving arm, said front coupling rod of said driving arm having a half-round top end inserted through one longitudinal slot of said holder arm and fitted into the half-round hole of said coupling arm, and a circular bottom end revolvably coupled to said bottom casing.

* * * * *